US008123155B2

(12) United States Patent
Petty

(10) Patent No.: US 8,123,155 B2
(45) Date of Patent: Feb. 28, 2012

(54) FENCE WIRE STRETCHING DEVICE

(76) Inventor: Samuel J. Petty, Vernon, TX (US)

( * ) Notice: Subject to any disclaimer, the term of this patent is extended or adjusted under 35 U.S.C. 154(b) by 301 days.

(21) Appl. No.: 12/592,740

(22) Filed: Dec. 2, 2009

(65) Prior Publication Data

US 2011/0127481 A1 Jun. 2, 2011

(51) Int. Cl.
*B65H 59/20* (2006.01)

(52) U.S. Cl. ..... 242/419.4; 242/567; 242/598.5; 242/129.6; 242/149

(58) Field of Classification Search ..... 242/402, 242/403, 403.1, 406, 407, 419, 419.4, 557, 242/566, 579, 580, 586, 586.4, 598, 598.3, 242/598.5, 129, 129.6, 129.7, 129.8, 149
See application file for complete search history.

(56) References Cited

U.S. PATENT DOCUMENTS 5,582,216 A * 12/1996 Smith et al. ..... 140/107
5,632,470 A * 5/1997 Leland ..... 254/385
5,806,779 A * 9/1998 Crum ..... 242/399.1
6,360,984 B1 * 3/2002 England ..... 242/557
7,011,269 B1 * 3/2006 Chouinard et al. ..... 242/557
7,530,522 B2 5/2009 Popp
2004/0065767 A1 * 4/2004 Parker ..... 242/557
2011/0121125 A1 * 5/2011 Stow et al. ..... 242/557

* cited by examiner

*Primary Examiner* — William E Dondero
(74) *Attorney, Agent, or Firm* — Lynn E. Barber

(57) ABSTRACT

A fence wire stretching device is provided having a square shape made up of five leg portions, three of which form three of the sides of the square. The fourth side of the square has a proximal leg portion and a distal leg portion that are pivotally attached together. The distal leg portion swings outward at an angle from the proximal leg portion so that the wire clamp mechanism is in an open position, and may then be pivoted back to be coaxial with the proximal leg so that the wire clamp mechanism is in a closed position. A vehicle attachment means is located at a first corner of the square, and a wire clamp mechanism is located at second corner of the square opposite the vehicle attachment means. A wire spool holding rod extends centrally across the square between a third corner and a fourth corner of the device, and is openably attached to the square so that a spool of fence wire may be slipped over the wire spool holding rod.

5 Claims, 5 Drawing Sheets

FENCE WIRE STRETCHING DEVICE

BACKGROUND OF THE INVENTION

1. Field of the Invention

This invention relates to fence construction, and in particular relates to a vehicle-mounted device for stretching fence wire, such as electric wire, between fence support structures such as posts.

2. Description of the Related Art

It is difficult and time-consuming to stretch lengths of fence wire, such as electric wire, between posts or other fence support structures. Typically the wire made of aluminum, steel, stainless steel or other fencing material is in a large, heavy spool. To make the fence, the wire is pulled from the spool which is located in a vehicle, such as in the back of a pickup truck. The wire is attached to an initial post, and then unwound to be long enough to reach the next post, stretched taut, and attached to the next post. Because of the distance between posts and the weight of the intervening wire, it is very difficult for one person to pull the wire taut enough, and generally two people are required.

There are known devices for holding the spool of wire in a particular position in or on the vehicle. Generally these devices do not provide a way of providing tension or tautness to the wire. The patent of Popps (U.S. Pat. No. 7,530,522) does provide a way to spool fencing from a vehicle that includes a frame that is configured to be attached to a motor vehicle, a pivotable cradle on the frame, a gripper assembly that is made of a gripper shoe, vertical axle and a gripper frame that rotates about the vertical axle and places the gripper shoe into contact with the spool of wire when manual force is placed on the handle by the operator of the motor vehicle. The rolls of wire are placed on the vertical cradle and wire is threaded between the gripper shoe and a fence guide. This prior device is a large complicated device with many parts that is preferably configured so that a handle of the device is accessible by the operator of a tractor on which the device is mounted. The means of attaching to a vehicle includes use of grip pins and a center mount.

It is therefore an object of the invention to provide an easily attachable and detachable portable fence wire stretching device that may be attached by one person to a standard trailer hitch adaptor and that extends behind the vehicle horizontally at the level of the hitch. It is a further object to provide a fence wire stretching device on which a roll of wire may be easily placed, and when sufficient wire has been pulled from the roll, the wire may be pulled taut and held in a taut position.

Other objects and advantages will be more fully apparent from the following disclosure and appended claims.

SUMMARY OF THE INVENTION

The invention herein is a fence wire stretching device having a square shape made up of five leg portions, three of which form three of the sides of the square. The fourth side of the square has a proximal leg portion and a distal leg portion that are pivotally attached together. The distal leg portion swings outward at an angle from the proximal leg portion so that the wire clamp mechanism is in an open position, and may then be pivoted back to be coaxial with the proximal leg so that the wire clamp mechanism is in a closed position. A vehicle attachment means is located at a first corner of the square, and a wire clamp mechanism is located at second corner of the square opposite the vehicle attachment means. A wire spool holding rod extends centrally across the square between a third corner and a fourth corner of the device, and is openably attached to the square so that a spool of fence wire may be slipped over the wire spool holding rod.

Other objects and features of the inventions will be more fully apparent from the following disclosure and appended claims.

DETAILED DESCRIPTION OF THE INVENTION AND PREFERRED EMBODIMENTS THEREOF

The invention herein is a fence wire stretching device on which a spool of fence wire, such as electrical wire may be held. The wire is spooled out in as known in the art, and when a sufficient length of wire has been pulled from the spool, the fence wire stretching device is used to clamp the wire and hold it tight as the vehicle is used to pull the wire from a distal place of attachment, such as a fence post.

Figure 1:
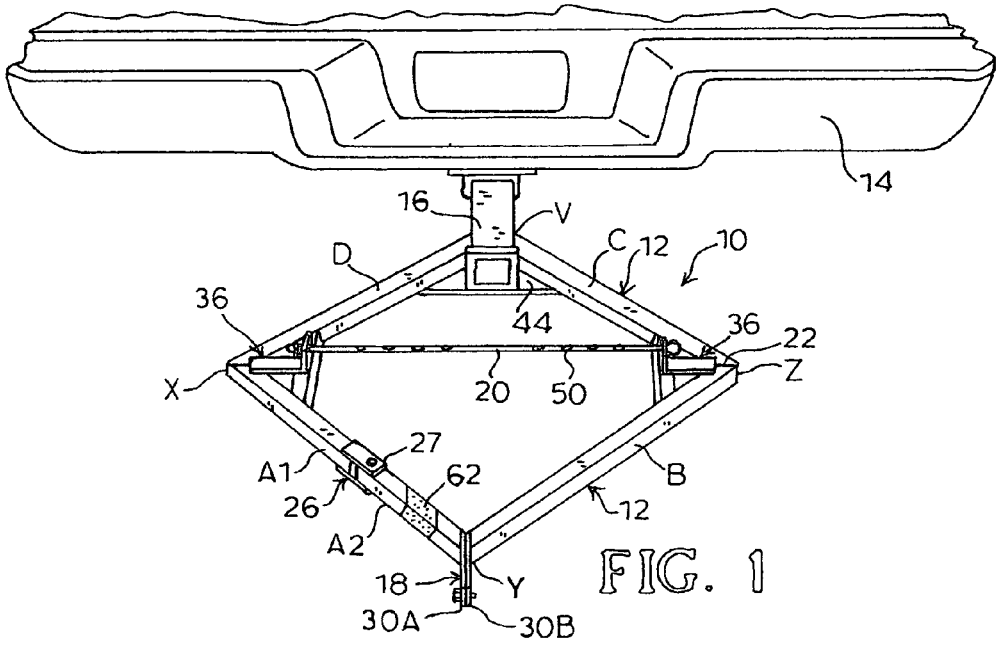
FIG. 1 is a perspective rear view of the fence wire stretching device of the invention in a closed position, mounted on a vehicle.
Figure 2:
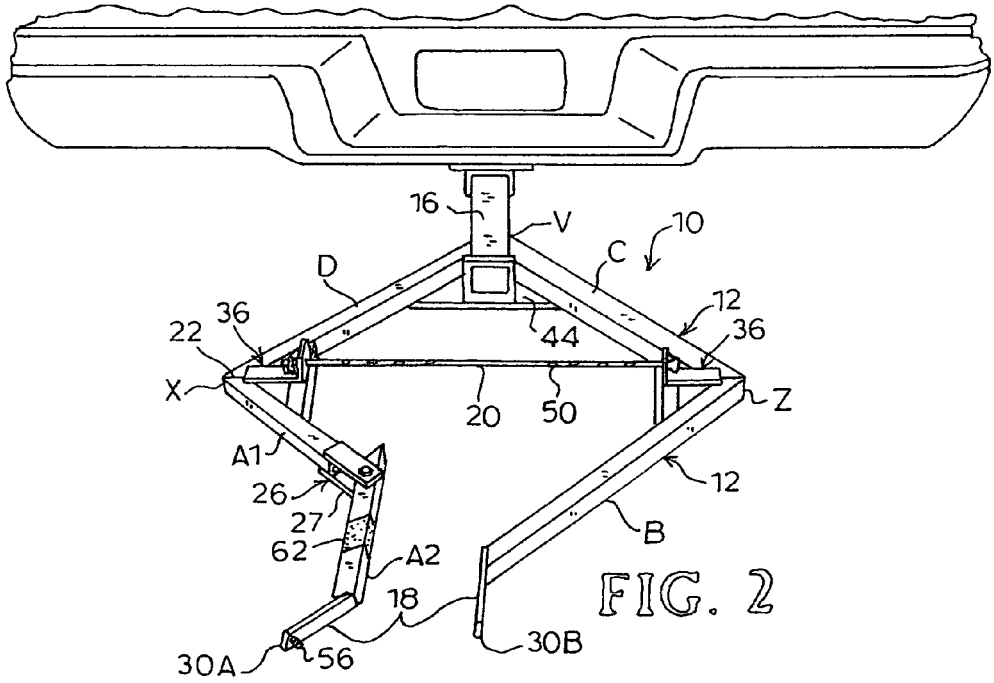
FIG. 2 is a perspective rear view of the fence wire stretching device of FIG. 1 in an open position, mounted on a vehicle.
Figure 3:
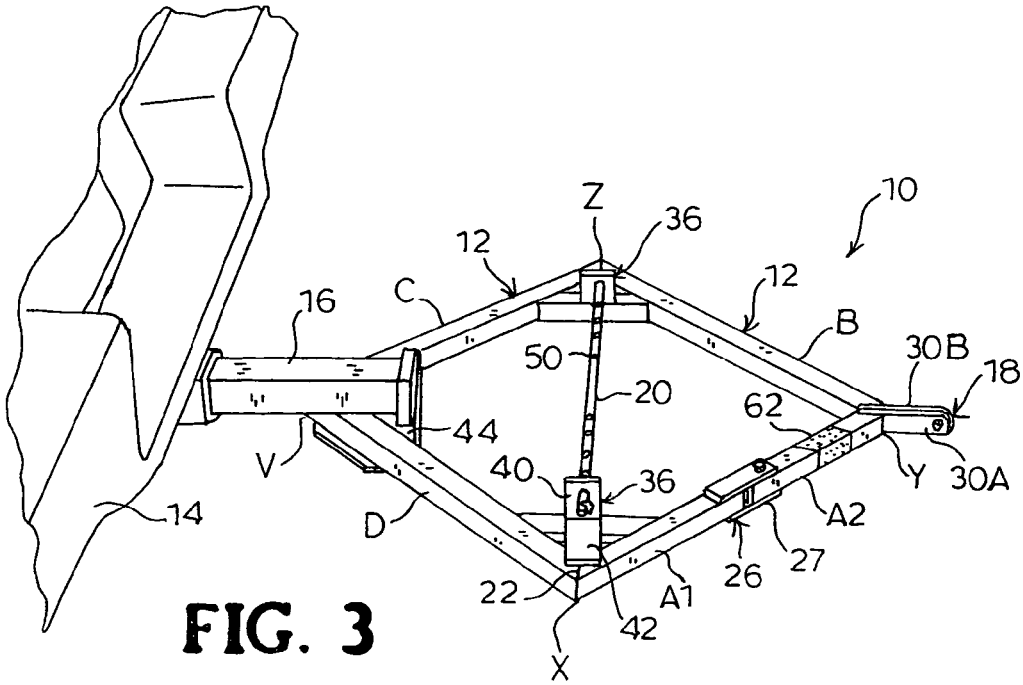
FIG. 3 is a perspective side view of the fence wire stretching device in the closed position, mounted on a vehicle.
Figure 4:
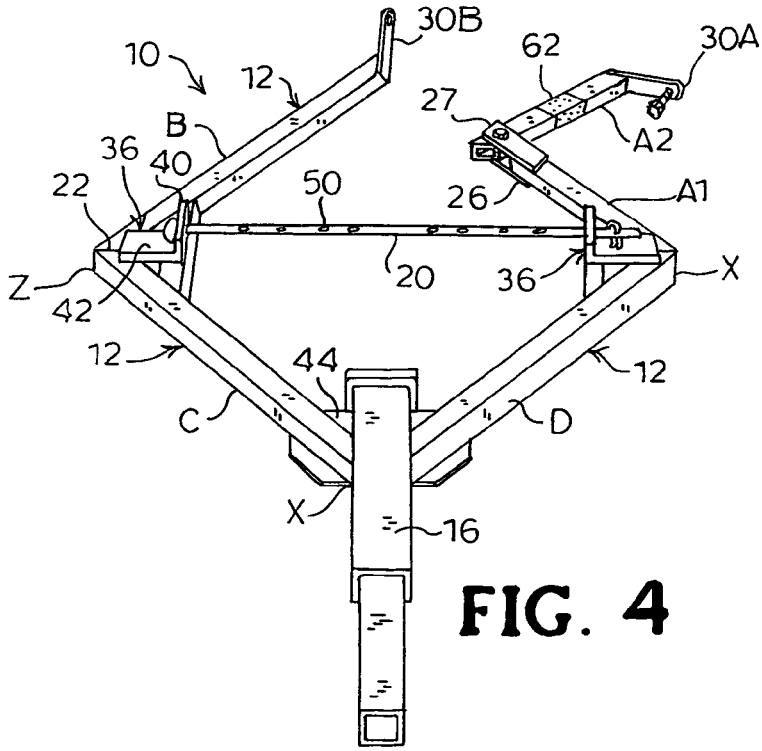
FIG. 4 is a perspective front view of the fence wire stretching device in the open position.

As shown in the figures (e.g., FIGS. 1-4 and 7-8), the fence wire stretching device 10 of the invention is preferably generally in the shape of a square with four sides 12 and four 90-degree corners. The fence wire stretching device is made of five leg portions, which are a first leg divided into smaller leg portions A1 and A2 that together are along one of the four sides of the device 10, and three single piece legs B, C, and D, each of which is along another side of the device to form the square shape. The leg portions form equal length sides of the device 10 when the device 10 is assembled. Leg portions A1 and A2 (together the first leg portion of the invention) are pivotally attached together so that the distal leg A2 may swing outward at an angle from proximal leg A1 as shown in FIG. 2 so that the wire clamp mechanism is in an open position, and may then be pivoted back to be coaxial with proximal leg A1 as shown in FIG. 1 so that the wire clamp mechanism is in a closed position. Leg portions B, C and D, are respectively referred to as the second, third, and fourth leg portions, with the four leg portions together forming a square as discussed and shown herein.

At a first corner V proximal to a vehicle 14 to which the device 10 is attached is a vehicle attachment means 16 for attaching to the vehicle 14, preferably for attaching to a receiver hitch or trailer hitch or similar device as known in the art, and having the same structure for attaching to a vehicle as known in the art. At the corner Y most distal from the vehicle is a wire clamp mechanism 18. Between the two remaining corners X, Z of the device, a wire spool holding rod 20 extends.

The term "perpendicular 45 degree angle" as used herein means that the 45 degree angle cuts on the two ends of a piece of square tubing are perpendicular to each other as shown for example on legs B-D, while a parallel 45 degree angle cut means that the 45 degree angle cut on the two ends of a piece of square tubing are parallel to each other as shown for example on piece A2.

Figure 7:
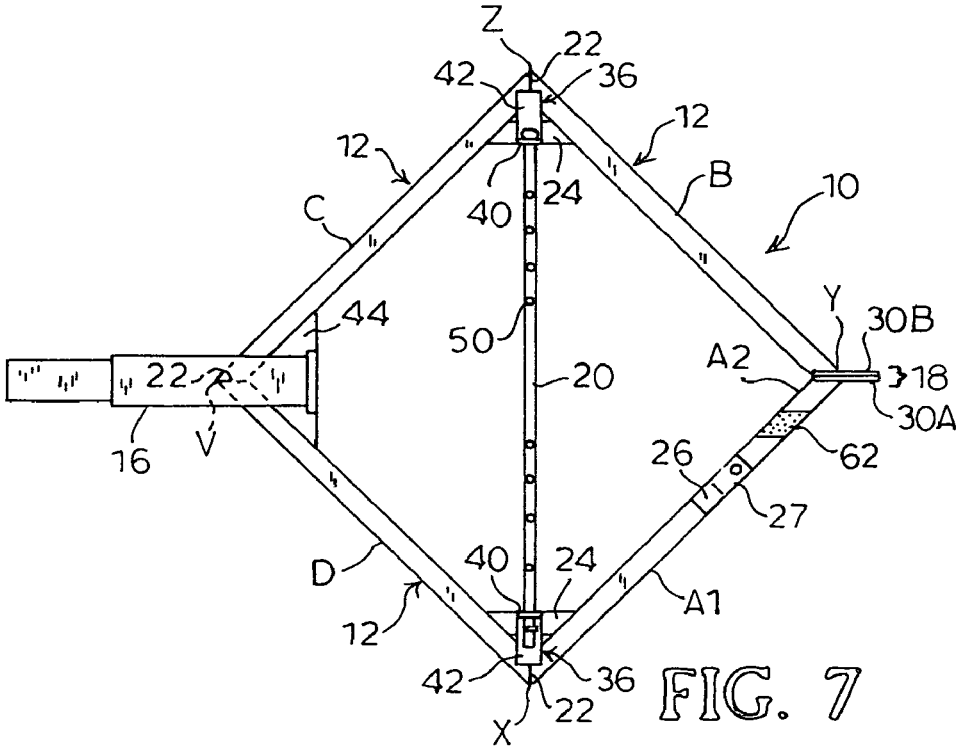
FIG. 7 is an upper plan view of the fence wire stretching device of the invention in a closed position.
Figure 8:
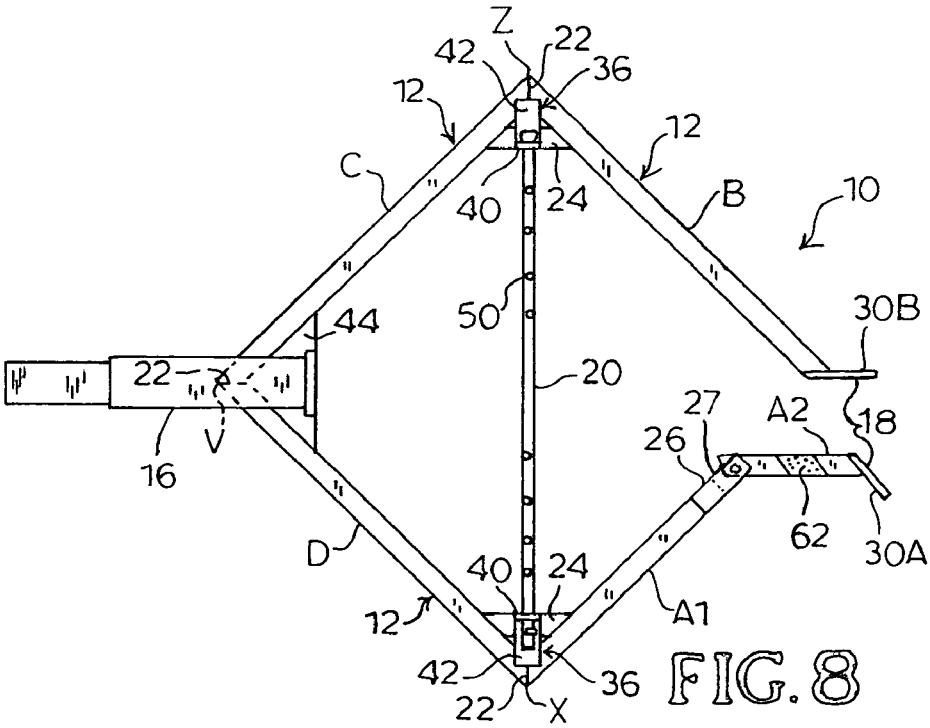
FIG. 8 is an upper plan view of the fence wire stretching device of the invention in an open position.

As shown in FIGS. 1-4 and 7-8, to make the device 10 of the invention, all of the leg portions (A1, A2, B, C, D) are preferably made of 1 inch square tubing, such as tubing made of steel as known in the art. Leg B is preferably cut about 20 inches long, and legs C and D are preferably 18¾ inches long when leg B is 20 inches long. Legs B-D have a perpendicular 45 degree angle cut 22 on each end of each leg piece as shown in FIG. 8.

Two shorter pieces 24 (6¼ inches long) of square tubing are cut, and perpendicular 45 degree angles are cut on both ends leaving a 6¼ inch side.

Leg A1 is formed to be 9½ inches long and is cut at a 45 degree angle at one end and a 90 degree angle on the other end as shown in FIG. 7. Leg A2 is 8½ inches long with parallel 45 degree angles on the ends.

Figure 5:
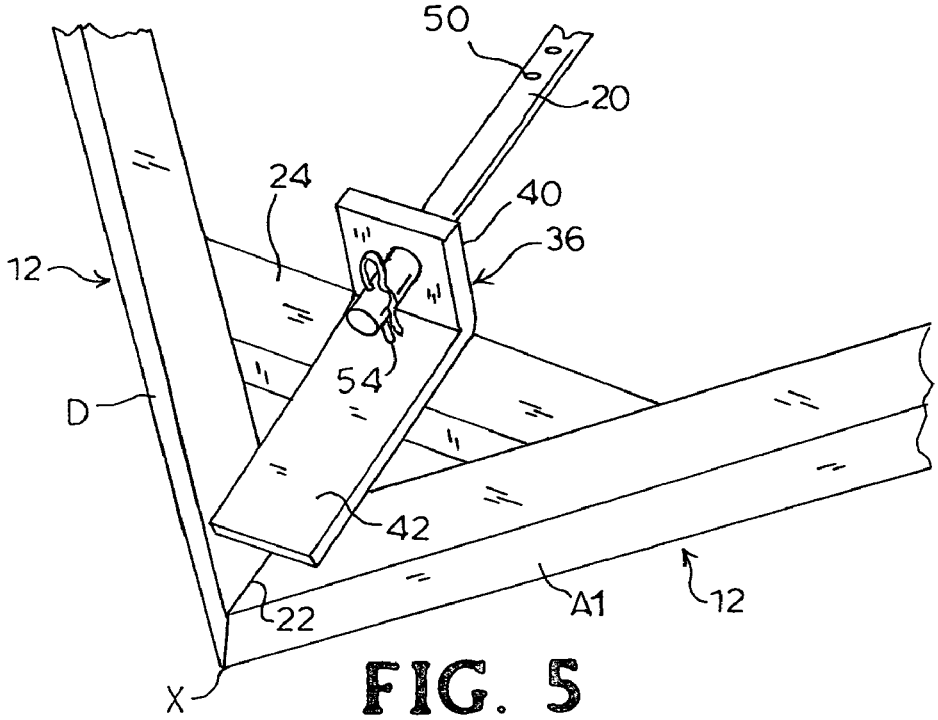
FIG. 5 is a perspective view of one of the L brackets of the fence wire stretching device attached to a corner of the device.

Legs D and C are tack welded together and to the chosen attachment means 16, preferably a 2½ inch receiver hitch adapter as known in the art. Leg A1 is tack welded to leg D and legs B and C are tack welded together in the position shown so that each corner between a pair of leg portions is at a 90 degree angle (FIGS. 7-8). Two shorter pieces of square tubing (6¾ inches long) are tack welded across the right angles formed by A1-D and B-C as shown in FIG. 5 to form a brace 24 at opposite corners X, Y of the device 10.

Figure 6:
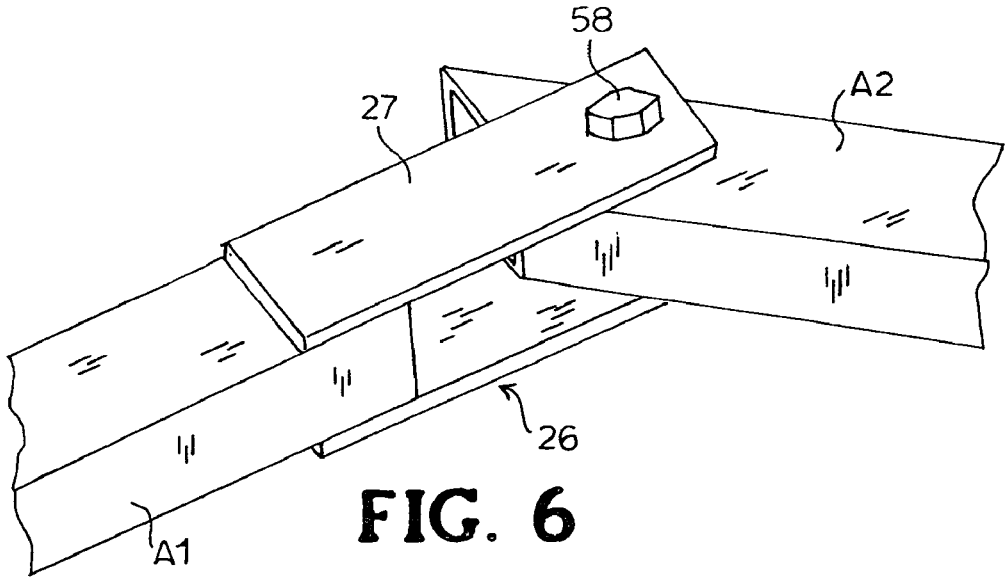
FIG. 6 is a perspective view of the pivotable junction of legs A1 and A2 of the fence wire stretching device of the invention.
Figure 9:
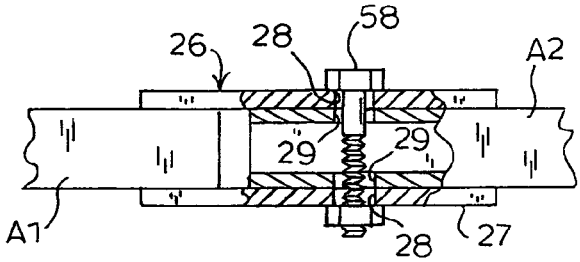
FIG. 9 is a partial side view of the joined leg portions A1 and A2 of the invention.

Two 4 inch pieces 26 of ¼ inch×1 inch flat steel are tack welded to the unattached end of leg A1 and parallel to each other, leaving a 3 inch extension 27 of the 4-inch pieces 26 extending beyond the end of leg A1 by welding 1 inch of each 4-inch piece 26 to leg A1 (FIGS. 6 and 9). A ⅜ inch diameter hole 28 is drilled through each 4 inch piece 26 at 1⅝ inch from the end of the 4 inch piece that is attached to leg A1 at ½ inch from the edge of the extension.

Two 4¾ inch metal strips 30A,B are cut from ¼ inch×1 inch flat steel. A ⅜ inch diameter hole 32 is drilled through one of the 4¾ inch pieces ¼ inch from one end (the smooth hole), and a ⅜ inch hole 34 is tapped/threaded ¼ inch from an end of the other 4¾ inch piece. The 4¾ inch piece with the smooth hole 30A is welded to leg A2 at the 45 degree angle face and the tapped 4¾ inch piece 30B is welded to leg B at the unattached 45 degree angle face. These two metal strips together with bolt 56 form the wire clamp mechanism 18.

All tack welds are then final welded.

Figure 10:
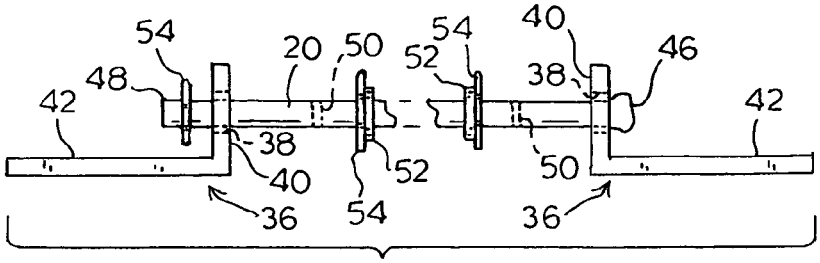
FIG. 10 is a partial side view of the wire spool holding rod of the invention.
Figure 12:
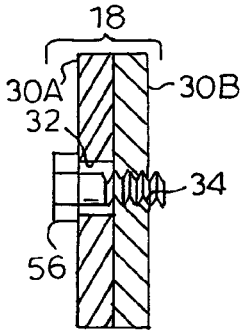
FIG. 12 is a cross-sectional view of the clamp mechanism of the invention.

Using two ⅜ inch×5 inch L brackets 36 (FIGS. 5 and 10), a ½ inch hole 38 is cut through the short arm 40 of each "L" bracket, ¾ inch from end. The long arm 42 of each L bracket 36 is welded to one of the opposite corners X, Y of the device 10, with the long arm 42 being welded both to the intersecting legs of the device and the brace 24 at that corner of the device.

A flat piece 44 of 4 inch×8 inch flat steel is welded to the bottom of the receiver hitch (attachment means 16) and to the attached portions of legs D and C to strengthen the device 10 at its point of attachment to a vehicle. Flat piece 44 is shown as rectangular; however, it may be made in any shape so long as it provides added strength to the attachment area of the device 10.

Figure 11:
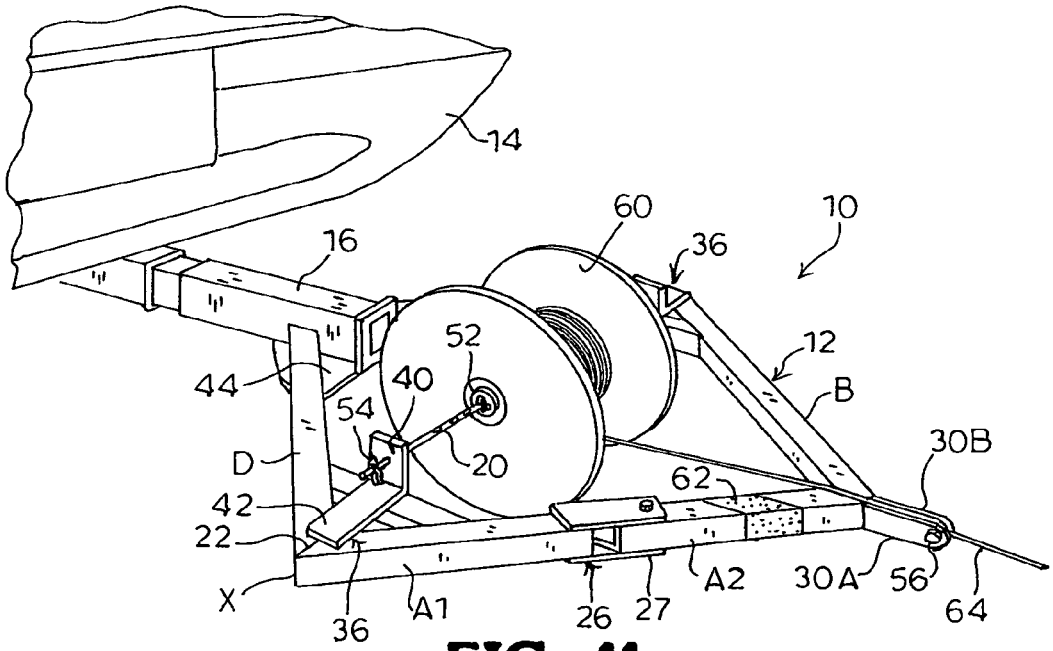
FIG. 11 is a perspective view of the fence wire stretching device with a spool of wire mounted on it and the wire end held in the wire clamp mechanism of the invention.

To form the wire spool holding rod 10, a 21-inch long piece of ½ inch round stock (e.g., steel, stainless steel or the like) is mushroomed at one end 46 as known in the art. On the opposite end 48 of the mushroom end 46 of the round stock, holes 50 are drilled at intervals, for example, at 5¾ inch, 6¾ inch, 7¾ inch, 12¾ inch, 13¾ inch and 14¾ inch from the opposite end 48, as well as at ¾ inch from opposite end 48. The wire spool holding rod 10 is pulled through the hole 38 in one of the L brackets 36, and two 2-inch washers 52 with a ½ inch center hole are slipped on to the wire spool holding rod 10. The free end 48 of the wire spool holding rod 10 is placed through hole 38 in the other L bracket 36. One 1½ inch cotter pin 54 is placed in the wire spool holding rod 10 in the ¾ inch distance hole on the end of the wire spool holding rod 10. Two other 1½ inch cotter pins 54 are placed in the desired location on the wire spool holding rod 10 to fit the wire spool size so that a cotter pin 54 is on each side of the wire spool as shown in FIG. 11 with the washers 52 on the wire spool holding rod 10 between the cotter pins 54 and the wire spool 60.

A hole 29 is drilled in leg A2 at ½ inch from the end of leg A2. Leg A2 is placed between the extensions 27 on leg A1 and the holes 28,29 are lined up. A half-threaded bolt 58 (¼ inch by 2¾ inch) is inserted through the lined up holes 27,28 and two corresponding sized nuts are threaded on the 2¾ inch bolts. The two nuts on each bolt are tightened in opposite directions as known in the art.

To finish assembly of the device, the entire device 10 is preferably painted with primer paint, and when dry is painted black. On leg A2, a section 62 that extends between 3¾ inches and 6¼ inches from hole 27 is painted red as an indication means to show where inside the device 10 to drive a standard T-post as known in the art. Preferably, to assist in centering the wire spool on the device, a ½ inch red stripe is painted on the round stock at 7¾ inch and 12¾ inch from the end the wire spool holding rod 10, a ½ inch yellow stripe is painted at 6¾ inch and 13¾ inch from the end the wire spool holding rod 10, and a ½ inch green strip is painted at 5¾ inch and 14¾ inch from the end the wire spool holding rod 10.

To use the device of the invention, the assembled device 10 is attached to a trailer receiver hitch on a truck or other vehicle. At or before reaching the fencing site, a spool 60 of wire is placed on the device 10 (FIG. 11) by pulling the wire spool holding rod 20 sufficiently outward from the L brackets so that end 48 is free of the L bracket and the wire spool 60 can be placed over the free end 48 of the wire spool holding rod holding rod 20 and centered between a pair of cotter pins 54 placed in holes 50, with a washer 55 on each side of the spool 60 between the cotter pin 54 and the spool 60. The wire spool holding rod 20 is again fixed in the L bracket 36 by placing a cotter pin in a hole nearest end 48.

Wire is pulled off the spool 60 by hand at the first T-post and attached to the first T-post insulator as known in the art. The vehicle is driven down the desired fence line and stopped at the desired position of the second T-post. The wire is placed between pieces 30A and 30B and the bolt is tightened The vehicle is pulled forward slowly until the desired tautness of the wire is reached. The second T-post is driven inside the device adjacent to leg A2. Wire is pulled from the spool to provide sufficient wire for attaching to the post, and wire is cut by hand and wrapped around the insulator as known in the art. The wire clamp mechanism 18 is opened to release the wire, being careful not to be clear of the wire as it is released from the wire clamp mechanism 18. The vehicle can then be pulled forward so that the opened device is pulled past and beyond the second T-post. Additional lengths of wire along the desired fence line are spooled and attached to posts in the same manner by repeating the above steps While the invention has been described with reference to specific embodiments, it will be appreciated that numerous variations, modifications, and embodiments are possible, and accordingly, all such variations, modifications, and embodiments are to be regarded as being within the spirit and scope of the invention.

What is claimed is:

1. A fence wire stretching device, comprising:

a) a first leg portion comprising a proximal leg portion and a distal leg portion that are pivotally attached together to form a first side of a square;

b) three long leg portions comprising a second leg portion, a third leg portion and a fourth leg portion, each of which long leg portions comprises one side of the square;

c) a vehicle attachment means at a first corner of the square that is between the third and fourth leg portions;

d) a wire clamp mechanism at second corner of the square opposite the vehicle attachment means between the distal leg portion and the second leg portion; and e) a wire spool holding rod extending centrally across the square between a third corner and a fourth corner of the device, and detachably attached to the square, wherein the distal leg portion swings outward at an angle from the proximal leg portion so that the wire clamp mechanism is in an open position, and the distal leg portion may then be pivoted back to be coaxial with the proximal leg portion so that the wire clamp mechanism is in a closed position for clamping wire.

2. The fence wire stretching device of claim 1, wherein the vehicle attachment means attaches to a receiver hitch.

3. The fence wire stretching device of claim 1, further comprising an L bracket attached to the third corner and an L bracket attached to the fourth corner, wherein a first end of the wire spool holding rod is positioned in one L bracket and a second end of the wire spool holding rod is removable from the other L bracket so that a spool of wire may be placed over the wire spool holding rod.

4. The fence wire stretching device of claim 1, further comprising an indication means for positioning of a post to which wire is to be attached.

5. The fence wire stretching device of claim 1, wherein the wire clamp mechanism comprises a pair of metal strips, one of which metal strips is attached to the distal leg portion and one of which metal strips is attached to a free end of the second leg portion.

* * * * *